United States Patent [19]

Totsuka et al.

[11] Patent Number: 4,997,529

[45] Date of Patent: Mar. 5, 1991

[54] ELECTROLYTIC PROCESS AND APPARATUS FOR FORMING PATTERN ON SURFACE OF METALLIC OBJECT

[75] Inventors: Nobuo Totsuka; Katsuhei Kikuchi; Takao Kurisu, all of Chiba, Japan

[73] Assignee: Kawasaki Steel Corporation, Hyogo, Japan

[21] Appl. No.: 403,670

[22] Filed: Sep. 6, 1989

[30] Foreign Application Priority Data

Sep. 6, 1988 [JP] Japan ..... 63-223196
Sep. 9, 1988 [JP] Japan ..... 63-226088

[51] Int. Cl.[5] ..... C25D 5/02; C25D 17/00
[52] U.S. Cl. ..... 204/15; 204/224 R
[58] Field of Search ..... 204/15, 129.65, 224 R

[56] References Cited

FOREIGN PATENT DOCUMENTS 40-13247 6/1965 Japan .
45-9444 4/1970 Japan .

*Primary Examiner*—T. M. Tufariello
*Attorney, Agent, or Firm*—Austin R. Miller

[57] ABSTRACT

An electrolytic process for forming a pattern on a metallic object makes use of a screen of electrically insulating material having a perforated pattern corresponding to the pattern to be formed on the metallic object. A paste containing an electrolyte is applied to the surface of the metallic object through the pattern of the screen. Electric current is supplied between the metallic object and an electrode placed in contact with the electrolyte-containing paste so that electrolysis takes place through the pattern of the screen on the surface of the metallic object. Disclosed also is an electrolytic apparatus suitable for use in carrying out the method.

13 Claims, 5 Drawing Sheets

ELECTROLYTIC PROCESS AND APPARATUS FOR FORMING PATTERN ON SURFACE OF METALLIC OBJECT

BACKGROUND OF THE INVENTION

1. Field of the Invention

The present invention relates to an electrolytic process and an electrolytic apparatus for forming a pattern on the surface of a metallic object.

2. Description of the Related Art

A method has been known in which portions of a metallic object which are not to be processed are covered by a resist so as to enable a desired pattern to be formed only on a selected portion of the metallic object This method is generally referred to as "photo-resist method" and is disclosed, for example, in Japanese Patent Examined Publication No. 60-15705.

This method, however, requires a number of laborious steps such as drafting of an original pattern, preparation of an original plate by a photographing plate making technique, pre-treatment of the surface to be processed, application of a photo-sensitive liquid, exposure, development, application of the resist to portions of the material other than the portion to be processed, electrolytic processing, rinsing, removal of the resist, rinsing, drying and finishing. Thus, the photo-resist method is generally expensive.

Methods are also known such as photo-etching, chemical milling and so forth. These methods, however, are generally time-consuming and tend to suffer problems such as uneven etching due to deterioration of the etching solution.

SUMMARY OF THE INVENTION

Objects of the Invention

Accordingly, it is an object of the present invention to provide a method for forming a pattern on the surface of a metallic object with a high resolution even when the pattern is minute or delicate, through etching, plating or coloring by a simple technique without necessitating the use of an electrolytic solution.

Another object of the present invention is to provide an apparatus suitable for use in carrying out the method of the present invention.

According to one aspect of the present invention, there is provided an electrolytic process for forming a desired pattern on the surface of a metallic object comprising the steps of: preparing a screen having a perforated pattern corresponding to the pattern to be formed on the metallic object; placing the screen on the metallic object in close contact therewith; applying a paste containing an electrode and the metallic object so as to cause electrolysis thereby forming the pattern on the metallic object.

Thus, the present invention makes use of an electrolyte-containing paste of controllable fluidity and reactivity (referred to simply as "paste" hereinafter) in place of conventionally used electrolytic solution The paste is applied to the surface of the metallic object to be processed through the perforated pattern in the screen placed in close contact with the surface of the metallic object, and electric current is made to flow between an electrode placed in contact with the paste and the metallic object, whereby electrolysis is effected to form the desired pattern on the surface of the metallic object.

Preferably but not necessarily a relative movement is effected between the paste and the surface of the metallic object during execution of the electrolysis so as to facilitate movement of the electrolyte on the boundary and to promote relief of gases generated by the electrolysis, whereby the pattern can be formed with a high degree of uniformity.

According to another aspect of the present invention, there is provided an electrolytic apparatus suitable for carrying out this electrolytic process.

Other objects, features and advantages of the present invention will become clear from the following description in the specification, and in the appended drawings.

DESCRIPTION OF THE PREFERRED EMBODIMENTS

Embodiments of the present invention will be described with reference to the accompanying drawings.

Figure 1:
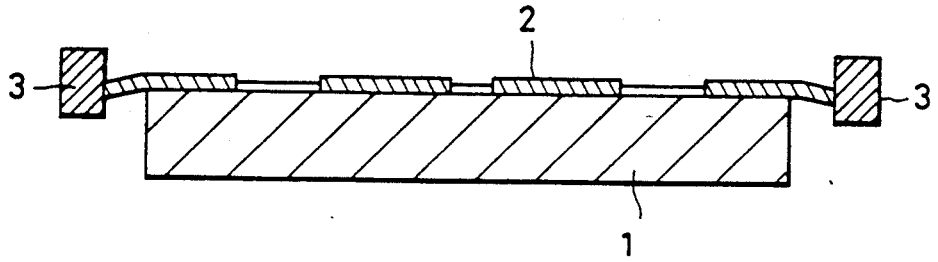
FIG. 1 is a sectional view of an apparatus in which a screen with an etching pattern is placed on a metallic member in close contact therewith, to perform a step of the electrolytic method embodying the present invention.

FIG. 1 is a sectional view of an apparatus for carrying out an electrolytic process in accordance with the present invention, by bringing a screen having an etching pattern into close contact with the surface of a metallic object. As shown in this Figure, the screen 2 having an etching pattern is placed on the surface of a metallic object 1 in close contact therewith. The screen 2 is held by a frame 3.

The screen 2 with etching pattern may be a screen made of a material ordinarily used in screen printing, such as nylon, tetron, polyester or the like, with a resist printed thereon, or may be a sheet formed from a nylon, vinyl chloride, teflon, electrical insulator coated stainless steel or alloy having a high Ni content with the etching pattern formed by a suitable method. The frame 3 should be capable of stably holding the screen 2 without allowing any slack of the screen 2.

It is also preferred that the screen 2 itself has a suitable level of elasticity so that it may be held in close contact with the surface of the material to be processed.

Figure 2:
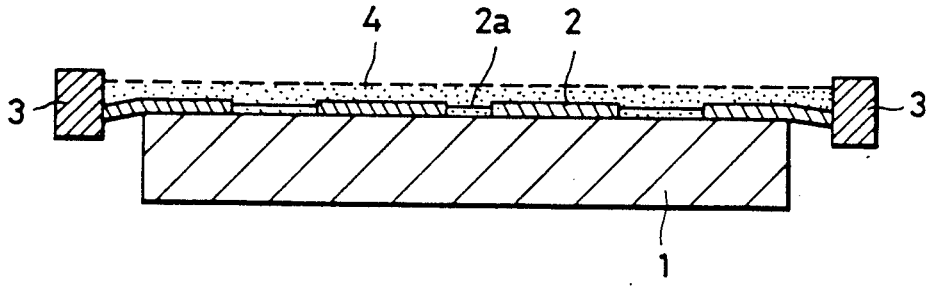
FIG. 2 is a sectional view of an apparatus in which a paste has been applied to the upper side of the screen with an etching pattern.
Figure 3:
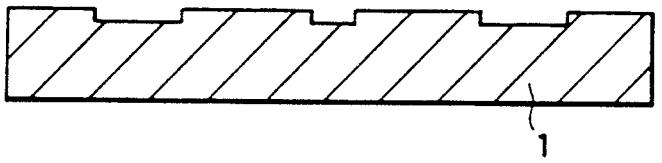
FIG. 3 is a sectional view of a metallic member after the etching.

Subsequently, paste 4 is applied to the upper side of the screen 2 having the etching pattern as shown in FIG. 2. In consequence, the paste is held in contact with the surface of the metallic object 1 through the etching pattern of the screen 2 as denoted by 2a. Therefore, the pattern carried by the screen 2 is formed on the surface of the metallic object 1 by conducting an electrolytic process through the paste pattern 2a. FIG. 3 is a sectional view of the metallic object after the completion of the etching.

The paste 4 can be prepared by adding a paste-forming agent to an alkali such as caustic soda, an acid such as hydrochloric acid, sulfuric acid, nitric acid, chromic acid, dichromic acid, hydrofluoric acid or a salt of one of the above-mentioned alkalis or acids, so as to form a paste. The alkali, acid or the salt may be used alone or in the form of one or more of these substances. Sodium polyacrylate, silicon dioxide, alumina, water glass, sodium alginate or the like material may be used as the paste-forming agent.

The paste has a viscosity which preferably ranges between 1,000 and 100,000 cp, more preferably between 5,000 and 50,000 cp.

When the viscosity of the paste is below 1,000 cp, the paste can hardly maintain the electrolyte only on the portion to be processed, because of excessive fluidity. On the other hand, a viscosity level exceeding 100,000 cp makes it difficult to relieve gases generated on the processed surface and the electrode. Excessive viscosity also makes it difficult to uniformly apply the paste.

A higher quality of the pattern on the metallic object can be obtained if the paste 4 is stirred by a brush or the like during the etching.

According to the present invention, a paste having controllable fluidity and reactivity is used in place of the electrolytic solution used in known electrolytic processes. It is therefore possible to form a clear pattern by etching without substantial side edges, simply by placing the screen having the etching pattern in contact with the member to be treated, thus eliminating provision of a photo-resist layer on the surface of the member to be processed.

The paste has limited fluidity so that it is rather easy to retain it on the surface of the member to be treated. It is therefore unnecessary to use an etching liquid tank which is used in holding a bath of etching solution in which the metallic object to be processed is immersed in the conventional process. It is possible to keep the screen held in contact with only the intended portion of the metallic object where the pattern is to be formed, thus enabling a selective etching. Furthermore, it is not necessary to effect an anti-etching treatment such as application of a resist to the portions of the surface of the metallic object where the etching is not to be effected, such as the reverse side of the metallic object and the side edges of the metallic member.

The reactivity and the fluidity of the paste can suitably be determined and selected in accordance with factors such as the kind of the material to be processed, material of the screen, size and required precision of the pattern, mesh size of the screen, processing time, processing condition, e.g., whether or not an electrolysis is conducted and whether the process is executed continuously or in a batch fashion, and so forth.

Figure 4:
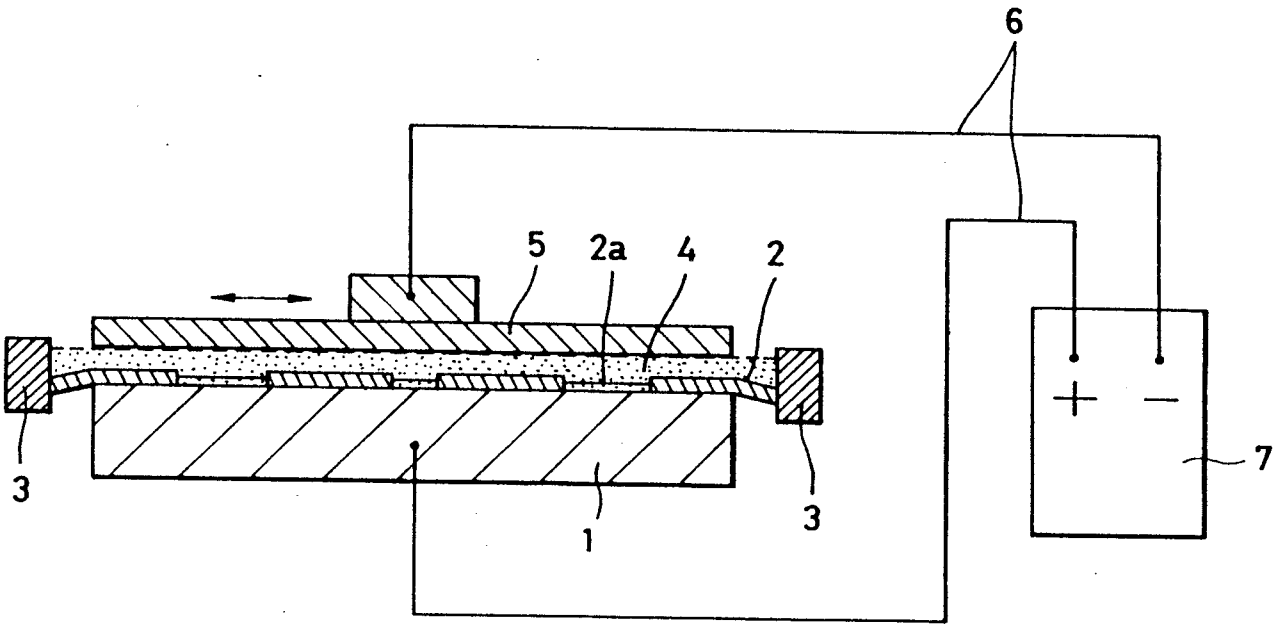
FIG. 4 is an illustration of an example of electrolytic etching conducted in accordance with the present invention.

FIG. 4 shows an example of the electrolytic etching executed in the process of the present invention.

The screen 2 made of an electrically insulating material and having an etching pattern is held in close contact with the surface of a metallic object 1, and the paste 4 is applied to the upper side of the screen 2. Then, a mobile electrode 5 is arranged in contact with the paste 4 and the electrode 5 and the metallic member 1 are connected to an electrolytic power supply 7 through leads 6. In consequence, electrolytic etching is effected only on the portion of the metallic object 2 contacted by the paste 4 through the portion 2a of the pattern on the screen, whereby the pattern is formed on the surface of the metallic object 1. It is to be understood that the paste can forcibly be agitated by moving or vibrating the electrode 5 so as to facilitate relief of gases while attaining uniform blending of the paste.

It is also to be understood that the use of an A.C. electrolytic current is effective in preventing side etching, while enabling formation of shallow etching holes of a uniform depth.

It is also possible to use, as the material of the electrode, copper, nickel, stainless steel, ordinary steel, titanium or other metal, as well as carbon, conductive ceramics and so forth. In addition, configuration of the electrode can be determined freely in accordance with the shape of the metallic member to be processed.

The metallic object to be treated also can have various shapes capable of allowing the screen to be held in close contact therewith, such as thin film, plate, strip, block and so forth.

The method of the invention can be carried out by simultaneous use of electrolysis with D.C. or A.C. current. The polarity and pattern of the electrical current are suitably determined in accordance with the types of the metallic object and the paste. Preferably, however, the electrolysis is conducted with A.C. power or by D.C. power using the member to be treated and the electrode as an anode and a cathode, respectively.

A description will be given of an embodiment in which the electrolytic process of the present invention is used for an electrolytic plating.

The electrolytic plating process is substantially the same as the electrolytic etching described before, but the composition of the paste and the polarity of the electrolysis may be varied.

Namely, in one case, the paste is prepared by adding a thickener to an ordinary plating solution or a solution containing a plating nucleide such as a mixture of a metal salt and an acid or an alkali. The thickener may be an organic thickener such as sodium polyacrylate, sodium alginate or xanthane gum, or an inorganic thickener such as zeolite, water glass, colloidal silica, colloidal alumina or sodium fluorosilicate. The organic or inorganic thickener maybe used alone or a mixture of one or more of organic and inorganic thickeners may be used as the thickener. The electrolytic plating is preferably conducted by using A.C. power or, alternatively, with D.C. power using the material to be treated and the electrode as an anode and a cathode, respectively.

The viscosity of the paste preferably ranges between 1,000 and 100,000 cp as in the case of electrolytic etching.

The electrolytic process in accordance with the present invention can be applied also to electrolytic coloring processing. The electrolytic coloring process in accordance with the present invention can be carried out substantially in the same manner as the electrolytic etching and electrolytic plating which were described before, except for the following points.

Namely, in this case, the paste may be prepared by adding a thickener to a coloring aqueous solution. Examples of the aqueous solution suitably used are aqueous solutions of an alkali such as caustic soda, caustic potash or ammonia, an aqueous solution of an acid such as hydrochloric acid, sulfuric acid, nitric acid, oxalic acid, hydrofluoric acid, chromic acid, bichromic acid, phosphoric acid, formic acid, acetic acid, malonic acid, maleic acid, malic acid, tartaric acid or the like, and an aqueous solution of a salt of the above-mentioned alkali or acid. The alkali, acid or the salt may be used alone or in the form of a mixture. Examples of the thickener suitably used are an organic thickener such as sodium polyacrylate, sodium alginate or xanthane gum, or an inorganic thickener such as zeolite, water glass, colloidal silica, colloidal alumina, sodium fluorosilicate or the like.

As in the case of electrolytic etching, the electrolytic coloring process is executed with A.C. power or, alternatively, by means of D.C. power using the member to be processed and the electrode as an anode and a cathode, respectively, and the viscosity of the paste preferably ranges between 1,000 and 100,000 cp.

A multi-color pattern can be formed by executing the coloring electrolytic process twice or more. Namely, a plurality of cycles of coloring electrolytic process may be executed with varying processing time so as to change the film thickness thereby developing a different color. Alternatively, a plurality of cycles of the coloring electrolytic process are executed with varying processing conditions so as to vary film thicknesses thereby causing a multiplicity of colors to be generated.

A description will be given hereinafter of an embodiment of the electrolytic process capable of forming a clear image on the surface of a metallic object even when the object surface is an indefinite curved surface. Examples of the metallic object to which this method can be applied are products of metals such as a plate, cup, pot, saucer or the like made of stainless steel, titanium, gold, silver, copper and so forth, and a laminate structure at least the surface layer of which is made of a metal.

Figure 5:
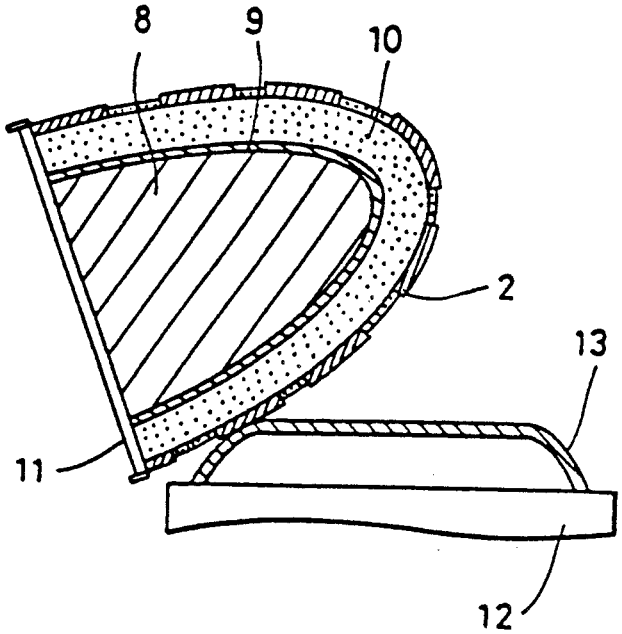
FIG. 5 is a fragmentary sectional view of a structure which is under an electrolytic process conducted with an electrode device.

This method employs a specific electrode device as described below. Referring to FIG. 5, a conductive layer 9 serving as an electrode is formed on an elastic member 8 having a flat surface or a desired curvature. A paste holding layer 10, made of an elastic material and impregnated with or adsorbing an electrolytic paste is provided on the conductive layer 9. In addition, a screen 2 is placed on the paste holding layer 10 in close contact therewith. This electrode device is used for effecting in electrolytic process on a metallic saucer 13 placed on a holder 12 as illustrated in the Figure.

The electrode 9, i.e., the conductive layer, of the electrode device and the metallic saucer are connected to a power supply through a suitable conductor means (not shown).

Various types of electrolytic processes such as etching, plating and coloring processes can be executed by selection of the composition of the paste and the electrolytic conditions. In each case, a pattern corresponding to an etching pattern carried by the screen is formed on the surface of the metallic saucer 13.

Examples of the elastic material 8 suitably used are synthetic rubbers such as silicon rubber, urethane rubber and so forth, or a natural rubber.

Any kind of conductive material can be used as the material of the conductive layer 9 on the elastic layer 8, provided that it has a flexibility large enough to enable the conductive layer 9 to be deformed in conformity with the curvature of the metallic object to be processed. Thus, a conductive resin or a metal foil can suitably be used as the material of the conductive layer 9. An example of the conductive resin is polyurethane resin containing carbon black or fine powder of copper dispersed therein. Examples of the metal foil suitably used as the material of the conductive layer 9 are foils of stainless steel, titanium, platinum, nickel and so forth.

The paste holding layer 10 may be formed from any material which can contain the paste without being adversely affected by the paste. Examples of such a material are woven or non-woven cloths of sponge, polyester, nylon, teflon and so forth.

The electrode device having the described construction can well follow any curvature of the surface of the metallic object simply by being positioned against the object surface, even if the curvature is complicated, so that the pattern carried by the screen can be reproduced on the curved object surface with a high degree of fidelity, thus enabling the electrolytic process to be carried out on an industrial scale.

A description will be given of an electrolytic process of the invention for producing a pattern on the surface of a metallic object by rotating a loop of a screen of the type described hereinbefore. In this case, the metallic object on which the pattern is to be formed has a continuous web-like form. The web-like metallic object is brought into close contact with the screen described before so as to form a laminate structure and this laminate structure is conveyed in synchronization with the screen. The above-described electrolytic process is executed during the conveyance so that a pattern corresponding to the pattern held by the screen is formed on the surface of the metallic object. In this embodiment, the metallic object is held in tight contact with the screen through magnetic attraction or adhesion The electrolytic process of this embodiment can be realized in various forms such as electrolytic processing, electrolytic etching, electrolytic plating and electrolytic color generation.

A description will be given hereinafter of an embodiment of the electrolytic apparatus in accordance with the present invention.

Briefly, this electrolytic apparatus comprises the following structural features: a rotational closed loop of a screen having a pattern perforated in accordance with the pattern to be formed on the metallic object; means for supplying the metallic object in a web-like form; means for taking-up the metallic object; means for forming and maintaining a laminate structure of the screen and the metallic object by bringing the screen into close contact with the metallic object and keeping the close contact over a predetermined distance of travel of the metallic object between the supplying means and the take-up means; an electrode facing the screen of the laminate structure at a predetermined electrolytic processing position; means for supplying a paste containing an electrolyte to the gap between the electrode and the metallic material at a region upstream from the electrode as viewed in the direction of movement of the metallic object; means for removing the paste at a region downstream from the electrode as viewed in the direction of movement of the metallic object; and means for supplying electrical current between the electrode and the metallic object of the laminate structure.

Preferably, the electrode has a flat tabular form or a roll-type form.

The details of the construction and the operation of this embodiment are as follows.

Figure 6:
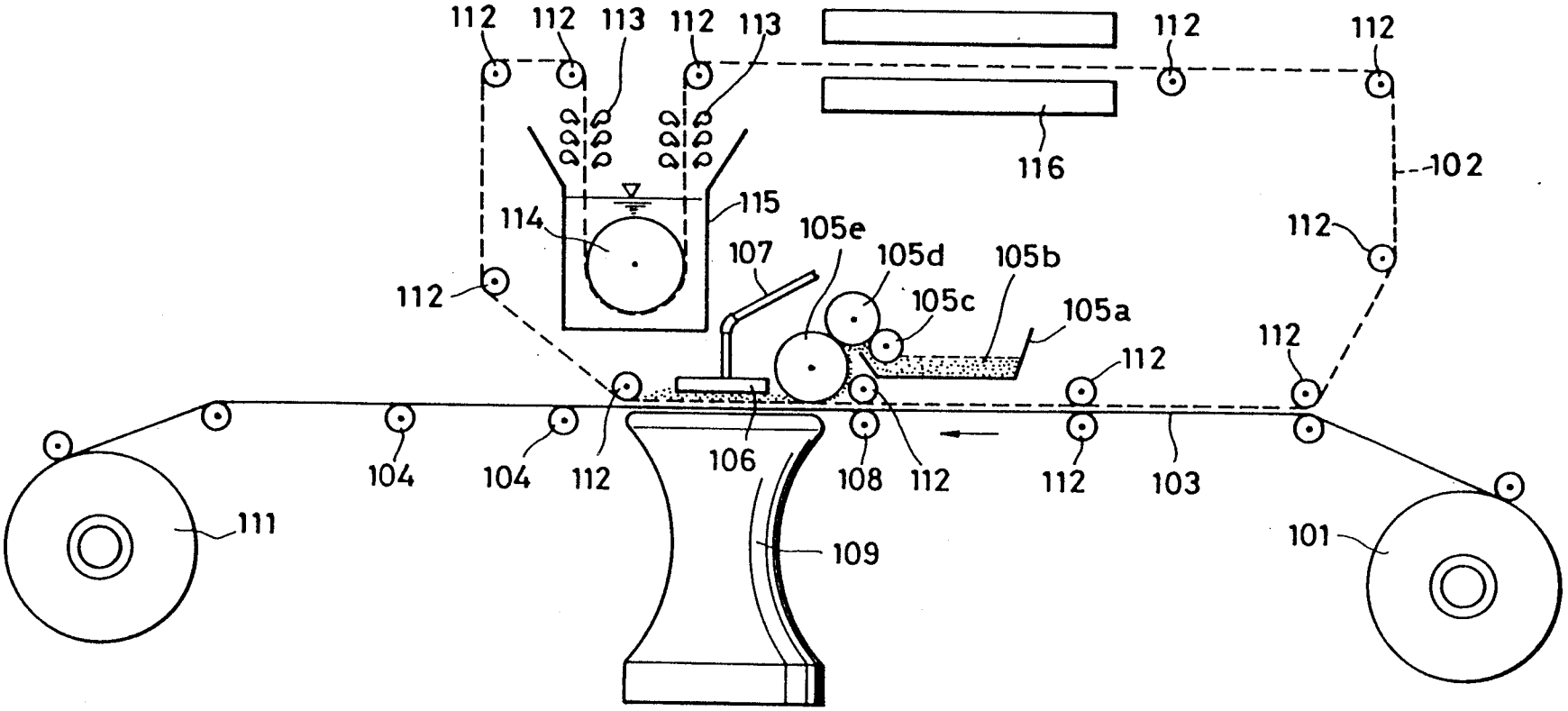
FIG. 6 is a diagrammatic side elevational view of an example of the electrolytic apparatus for forming a pattern on a metallic object in accordance with the present invention.
Figure 7:
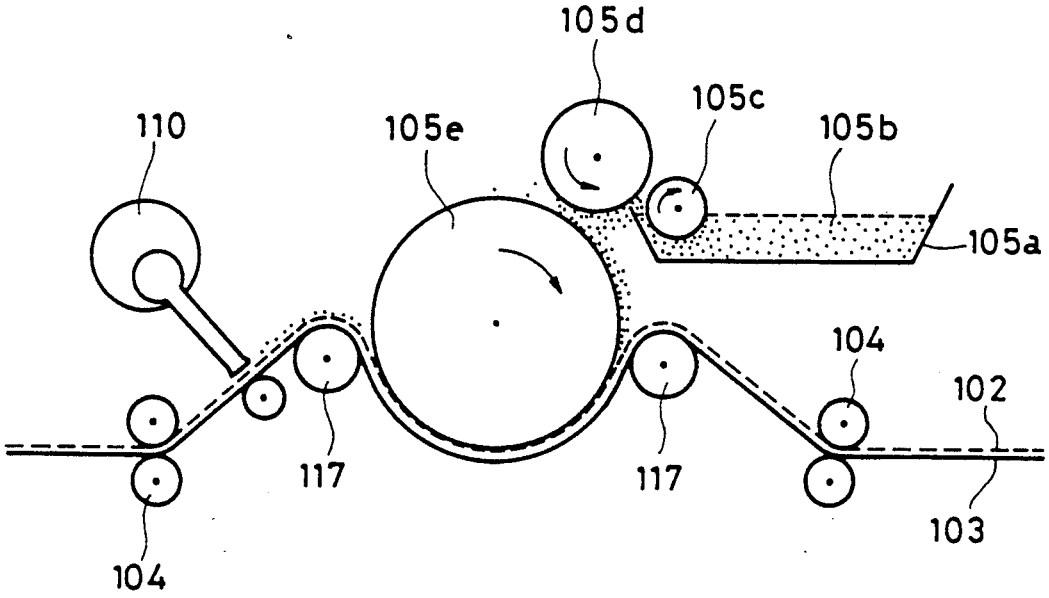
FIG. 7 is a diagrammatic side elevational view of an apparatus for conducting the electrolytic process of the present invention by making use of a rolled electrode and a laminate structure wound around the roll electrode.

Referring to FIG. 6, a metallic object such as a strip 103 is continuously supplied by a supply roll 101 and is conveyed along guide rolls 104 so as to be taken-up by take-up roll 111. A closed loop of a screen 102, carrying a perforated pattern corresponding to the pattern to be formed on the metallic object 103 is arranged to contact the metallic object 103 for rotation in synchronization with the movement of the metallic object 103.

During their joint movement, the metallic object 103 and the screen 102 are guided through a nip between the drive rollers 112, 112 so as to form a laminate structure. The metallic object 103 and the screen 102 are separated from each other after undergoing the electrolytic process.

When the laminate structure passes through the electrolytic processing section where a supporting table 109 is provided, a paste 105*b* is applied to and through the screen 102 and the above-described electrolytic process is executed.

In order to securely hold the screen in contact with the metallic object so as to stably maintain the laminate structure, the screen 102 preferably has a magnetic attracting layer at least on the side of the screen contacting the metallic object. The magnetic attracting layer may be formed by dispersing magnetic powder particles in the resin film of the screen. Alternatively, the laminate structure may be formed and maintained by providing the screen with an adhesive layer such as a layer of an adhesive rubber layer. It is also possible to form and maintain the laminate structure by applying to the screen surface an adhesive of the vinyl acetate type, acrylic resin type, or natural or synthetic rubber type so as to enable the screen to be adhered to the metallic object. The method for forming and maintaining the laminate structure should be determined in accordance with factors such as the composition of the paste, taking into account the reactivity with the paste and ease of separation of the screen after execution of the electrolytic process. Namely, it is preferred to use a method which does not cause any reaction with the paste and which facilitates the separation of the screen from the metallic object after having performed the electrolytic process. It is to be understood, however, that the described methods for forming the laminate structure are only illustrative and the invention does not exclude the use of other suitable methods.

An electrode 106, which has a flat tabular form in this embodiment, is disposed above the supporting table 109. The electrode 106 is held by an electrode holder 107 which is arranged so as to be suitably located with respect to the laminate structure.

The paste 105*b* for the electrolytic process is supplied from a paste hopper 105*a* to the gap between the electrode 106 and the screen 102 of the laminate structure at the upstream side of the electrode 106 as viewed in the direction of movement of the laminate structure, through a pick-up roll 105*c*, intermediate roll 105*d* and an application roll 105*e*. The paste can reach the metallic object 103 through the perforated pattern provided in the screen 102 so that the gap between the electrode 106 and the portion to be processed of the metallic object 3 of the laminate structure is filled with the paste 105*b*.

While the gap between the metallic object 103 and the electrode 106 is filled with the paste 105*b*, electrical power is supplied from a suitable power supply (not shown) which is connected to the metallic object 103 through a conductor roll 108 and to the electrode 106 through a suitable power supply line (not shown), whereby electrolysis is conducted to effect etching, plating, coloring and so forth in accordance with the selected paste composition and electrolytic conditions. In consequence, a pattern corresponding to the pattern carried by the screen is formed on the metallic object.

When a specifically long electrolytic processing time is required, the feed of the laminate structure may be done intermittently so that a predetermined area of the metallic object is treated for a predetermined time during the suspension of the feed and then the laminate structure is fed by a predetermined distance for the processing of the next unit area.

The paste on the laminate structure after completion of the electrolytic process is removed at a position which is downstream of the electrode 106 as viewed in the direction of feed of the laminate structure. The screen is then passed through a washing spray device 113 and then through a washing tank 115 having a washing roll 114 so that any residual paste is removed. The screen 102 is then dried as it passes through a drier 116.

Thus, the screen 102 carries the paste away from a region downstream from the electrolytic processing region, i.e., downstream from the electrode 106, and is made to return through the spray device 113, washing tank 115 and the drier 116 so as to be washed and dried. The dried portion of the screen 102 is then fed again into contact with the metallic object. It will be seen that the use of the closed loop-type screen facilitates the continuous processing.

When a specifically long electrolytic processing time is required, it is possible to use a plurality of electrolytic processing units in a single processing line, each unit including the processing support table, electrode, paste applying device and paste collection system. In such a case, however, the arrangement may be such that the paste supplying device and the paste collection system are provided only upstream from the first electrolytic processing unit and downstream from the last electrolytic processing unit. Examples:

The invention will be more fully understood from the following description of Examples.

Example 1 (Electrolytic Etching)

Electrolytic etching was conducted by using a paste which was prepared by adding 3 wt % of an aqueous solution of sodium polyacrylate to an aqueous solution containing 10 wt % of sulfuric acid and 1 wt % of sodium chloride. The viscosity of the paste was adjusted to 21,000 cp.

An SUS 304 stainless steel sheet 1.6 mm thick, 100 mm wide and 100 mm long, polished by emery cloth down to a fineness of #1200 was used as the metallic object to be processed. A lead wire was connected to a steel plate 2 mm thick, 50 mm long and 50 mm wide so as to connect the steel plate 2 as an electrode. In order to prevent the screen from being damaged, the electrode was wrapped with a polyester cloth.

A commercially available polyester screen for screen printing (#200) having a flower pattern for etching, was used as the screen.

A lead wire was connected by soldering to the reverse side of the material to be processed. Then, the screen with the etching pattern was placed in close contact with the surface of the metallic object to be processed and the paste was applied to the surface of the screen. Then, the electrode wrapped with a polyester cloth sufficiently impregnated with the paste was placed on the paste and the lead wires were connected to a D.C. power supply such that the electrode served as a cathode while the stainless steel sheet served as an anode. Electrical current of 3A was supplied for 30 seconds while the electrode was moved manually.

Comparison Example 1 (Electrolytic Etching)

For the purpose of comparison, electrolytic etching was conducted on the same stainless steel sheet and the same steel electrode as those used in Example 1, in accordance with a conventional photo-etching technique under the same etching condition as Example 1. The quality of pattern formed on the stainless steel sheet by Example 1 was substantially equivalent to that formed by Comparison Example 1, though the process of Example 1 was much simpler than that of Comparison Example 1.

Example 2 (Electrolytic Etching)

Electrolytic etching was executed by using the same paste and etching apparatus as Example 1, except that the D.C. power was replaced by A.C. power. The supply of the A.C. power was conducted in three consecutive cycles each including a 10-second supply of 3A current with the electrode and the stainless steel sheet held at the (−) and (+) electrodes, respectively, and a subsequent 5-second supply of 1A current with the potentials reversed. Thus, the electrical power supply was maintained for 45 seconds. The pattern formed by this electrolytic etching was compared with that formed by Comparison Example 1. The quality of the thus formed pattern was excellent with reduced side etching, well standing comparison with that of Comparison Example 1. From this fact, it is understood that the use of A.C. power in the electrolytic etching process is effective in reducing side etching, though the etching time is somewhat prolonged.

As will be understood from the description of Examples 1 and 2, it will be seen that the present invention enables pattern etching to be effected in a much more simple manner than by the conventional techniques.

Example 3 (Electrolytic Plating)

Pattern electroplating was executed by using, as a plating solvent, a paste which was prepared by adding 25 g/l of sodium polyacrylate in an aqueous solution (plating solution) containing 200 g/l of copper sulfate and 50 g/l of sulfuric acid.

A test piece of 1.6 mm thick, 100 mm long and 100 mm wide, cut out of a commercially available nickel sheet, was polished by emery cloth down to fineness of #1200 and the thus obtained test piece was used as the metallic object to be treated. A lead wire was connected to a copper plate 2 mm thick, 50 mm wide and 50 mm long for use as the electrode. In order to prevent the screen from being damaged by the electrode, the electrode was wrapped in an woven polyester cloth. Electroplating was executed by employing the same screen as that used in Example 1. The paste was applied to the upper side of the screen.

A lead wire was soldered to the reverse side of the metallic object to be treated and a screen with the plating pattern was placed on the surface of the metallic material to be processed in close contact therewith. Then, the electrode wrapped with the polyester woven cloth sufficiently impregnated with the paste was placed on the paste applied to the metallic object to be processed, and the electrode and the metallic object to be processed were connected to a D.C, power supply such that the electrode served as an anode while the nickel plate served as a cathode. Then, electric current of 3A was supplied for 30 seconds, during which the electrode was moved manually.

Comparison Example 2 (Electrolytic Plating)

For the purpose of comparison, electroplating was conducted on the same nickel sheet and the same copper electrode as those used in Example 3, in accordance with the conventional photo-etching technique by dipping the nickel sheet in a plating bath under the same condition as Example 3. The quality of pattern formed copper plating on the nickel sheet by Example 3 was substantially equivalent to that formed by Comparison Example 2, though the process of Example 3 was much simpler than that of Comparison Example 1.

Example 4 (Electrolytic Coloring)

An electrolytic coloring process was executed by using, as a coloring solvent, a paste which was prepared by adding 0.3 wt % of xanthane gum to 3 wt % of aqueous solution of phosphoric acid.

A test piece of 1.6 mm thick, 100 mm long and 100 mm wide, cut out of a commercially available titanium sheet, was polished by emery cloth down to fineness of #1200 and the thus obtained test piece was used as the metallic object to be treated. A lead wire was connected to a stainless steel plate 2 mm thick, 50 mm wide and 50 mm long for use as the electrode. In order to prevent the screen from being damaged by the electrode, the electrode was wrapped in an woven polyester cloth. Electroplating was executed by employing the same screen as that used in Example 1, as the coloring screen. The paste was applied to the upper side of this screen.

A lead wire was soldered to the reverse side of the metallic object to be treated and a screen with the plating pattern was placed on the surface of the metallic object to be processed in close contact therewith, and the paste was applied to the screen. Then, the electrode wrapped with the polyester woven cloth sufficiently impregnated with the paste was placed on the paste applied to the metallic object to be processed, and the electrode and the metallic object to be processed were connected to a D.C. power supply such that the electrode served as a cathode while the titanium plate served as an anode. Then, electric current was supplied such that an electrical current density of about $1A/cm^2$ was obtained over the surface of the titanium plate. The supply of the electric current was continued under the same condition until the voltage rose to 15 V and, thereafter, the supply of electrical current was maintained for 10 minutes while keeping the voltage at V. As a result of this processing, a flower pattern of gold interference color was formed on the titanium plate.

Example 5

A pad of a construction as shown in FIG. 5 was prepared by using an elastic member made of a silicon rubber, an electrode made from a conductive resin prepared by dispersing carbon black in polyurethane, a paste holding layer made of a polyester non-woven cloth, and a screen made from nylon. The screen had a wave-like pattern which was formed through a plate-making process by applying a photosensitive emulsion to a mono-filament screen.

Using this pad, a coloring process was executed on a flat saucer made of stainless steel and having a Ti layer formed by vacuum deposition. A wave pattern of gold color was formed after a 10-second electrolytic process The color generating electrolytic paste used in this Example was prepared by adding 3 wt % of polyacrylate to 10 wt % of sulfuric acid. The coloring electrolytic process was conducted at a constant voltage of 15 V, using the electrode and the metallic object as the minus and plus electrodes, respectively, at an electrode spacing of about 4 mm.

Example 6 (Processing and Etching)

A paste was prepared by adding 1.5 wt % of xanthane gum to an aqueous solution containing 5% $H_2SO_4$ and 1% $FeCl_3$. Using this paste, electrolytic processing was conducted on an SUS 304 stainless steel plate of 0.5 mm thick, 100 mm wide and 2000 mm long, by employing an apparatus as shown in FIG. 6.

The electrolytic processing was executed under the following conditions using a screen prepared by forming, in a nylon mono-filament screen of 200 mesh, a perforated pattern was formed by a plate-making technique, having a multiplicity of cross-shaped marks 4 mm wide and 4 mm high with a line thickness of 1 mm and arranged at 4 mm pitch both in the longitudinal and lateral directions.

Speed of movement of laminate structure: 60 cm/min
Electrode configuration: 5 mm thick, 100 mm wide and 100 mm long
Electrode spacing: about 2 mm
Electrolytic current: 2 A
Electrolytic voltage: about 10 V
Polarity: Electrode served as (−) electrode while stainless steel sheet served as (+) electrode
Rate of supply of paste: About 150 cc/min In consequence, cross-shaped grooves 4 mm wide and 4 mm high were formed at a line thickness of about 1 mm and a depth of about 10 pm without substantial distortion of the cross configuration over the entire area of the sheet of 0.5 mm thick, 100 mm wide and 2000 mm long in a processing time of 200 seconds.

Example 7 (Plating)

A paste was prepared by adding 3 wt % of sodium polyacrylate to an aqueous solution containing 5% $H_2SO_4$ and 15% $CuSO_4$. Using this paste, plating was conducted by employing the apparatus of FIG. 6, on a cold-rolled steel sheet 0.4 mm thick, 100 mm wide and 2000 mm long so as to form a pattern similar to that of Example 6 composed of a multiplicity of cross-shaped marks. Plating was executed under the following conditions Speed of movement of laminate structure: 10 cm/min
Electrode spacing about 2 mm
Electrolytic current 60 mA
Electrolytic voltage: about 7 V
Polarity: Electrode served as (+) electrode while steel sheet served as (−) electrode
Rate of supply of paste: About 25 cc/min In consequence, a pattern of copper plating composed of the cross-marks corresponding to those on the screen was formed in about 20 minutes.

Example 8 (Coloring)

polyacrylate to a 10% $H_2SO_4$ solution. Using this paste, an electrolytic coloring process was executed employing the apparatus of FIG. 6, so as to form a pattern composed of cross-marks similar to those in Examples 6 and 7, on a titanium sheet 0.5 mm thick, 100 mm wide and 2000 mm long. The material of the screen and the pattern formed on the screen were the same as those in Examples 6 and 7. The electrolytic coloring process was conducted under the following condition.

Speed of movement of laminate structure: 60 cm/min
Electrode spacing: about 2 mm
Electrolytic voltage: maintained constant at 15 V
Polarity: Electrode served as (−) electrode while titanium sheet served as (+) electrode
Rate of supply of paste: 150 cc/min In consequence, a pattern of a multiplicity of cross-shaped marks was formed in gold color on the titanium plate without using any resist material.

As has been described, according to the present invention, a paste having suitable levels of tackiness or viscosity is used in place of the electrolytic solution used in conventional electrolytic processes. By suitably controlling the composition of the paste, conditions of electrolysis and the nature of a screen with a pattern, it is possible to continuously conduct various electrolytic processing such as fine processing, etching, coloring and plating through effecting a continuous relative movement between an electrode and the member to be processed. The electrolytic process of the present invention is simple but yet capable of providing, at a reduced cost, various functional or design patterns such as a figure or picture of a high quality on a metallic object and other products.

In one embodiment of the present invention, the electrode device in the form of a pad has an elasticity and flexibility large enough to follow any curvature of the surface to be processed, so that the electrolytic process of the invention can be effected on various objects having complicated curved configurations.

What is claimed is:

1. An electrolytic process for forming a desired pattern on the surface of a metallic object comprising the steps of:

preparing a screen of electrically insulating material having a perforated pattern corresponding to the pattern to be formed on said metallic object;

placing said screen on said metallic object in close contact therewith;

applying an electrically conducting paste containing an electrolyte to said surface of said metallic object through said screen;

placing an electrode in contact with said paste; and causing an electric current to flow between said electrode and said metallic object so as to cause electrolysis thereby forming said pattern on said metallic object, and moving said paste and said surface of said metallic object relative to each other during execution of said electrolysis, wherein said relative movement is caused by a movement or vibration of said electrode.

2. An electrolytic process for forming a desired pattern on the surface of a metallic object comprising the steps of:

preparing a screen of electrically insulating material having a perforated pattern corresponding to the pattern to be formed on said metallic object;

placing said screen on said metallic object in close contact therewith;

providing an electrode in close contact with an electrically conducting paste, said electrode having a paste holding layer made of an elastic material and impregnated with or adsorbing said paste; and causing an electric current to flow between said electrode and said metallic object so as to cause electrolysis thereby forming said pattern on said metallic object.

3. An electrolytic process for forming a desired pattern on a metallic object comprising:

preparing a screen of electrically insulating material in the form of a closed loop and having a pattern perforated in accordance with the pattern to be formed;

forming a laminate structure by superposing a portion of said loop of said screen on said metallic object in close contact therewith;

applying an electrically conducting paste to a predetermined portion of said metallic object through said screen of said laminate structure at a predetermined electrolytic processing position;

and effecting an electrolysis on said metallic object through said paste and said screen at said electrolytic processing position, thereby forming said pattern on the surface of said metallic object.

4. An electrolytic process according to claim 3, wherein said metallic object has a web-like form and is fed from a supply roll to a take-up roll, said laminate structure being formed by bringing a portion of said loop of said screen into close contact with an intermediate portion of said metallic object moving between said supply roll and said take-up roll and moving said screen in synchronization with the movement of said metallic object, said electrolysis being effected on said laminate structure when said laminate structure passes said electrolytic processing position.

5. An electrolytic process according to either one of claims 3 and 4, wherein said laminate structure is formed and maintained by bringing said screen into close contact with said metallic object by magnetic attraction or by means of an adhesion.

6. An electrolytic process according to one of claims 1, 2 and 3, wherein said electrolytic process is caused to effect one of electrolytic processing, electrolytic etching, electrolytic coloring and electrolytic plating.

7. An electrolytic process according to one of claims 1, 2 and 3, wherein said paste has a viscosity ranging between 1,000 and 100,000 cp.

8. An electrolytic process according to one of claims 1, 2, 3 and 6, wherein the electrolysis is conducted with A.C. electric power.

9. An electrolytic apparatus for forming a desired pattern on the surface of a metallic object comprising:

a rotational closed loop of a screen of electrically insulating material having a pattern perforated in accordance with the pattern to be formed on said metallic object;

means for supplying said metallic object in a web-like form;

means for taking-up said metallic object;

means for forming and maintaining a laminate structure of said screen and said metallic object by bringing said screen into close contact with said metallic object and keeping the close contact over a predetermined distance of travel of said metallic object between said supplying means and said take-up means;

at a predetermined electrolytic processing position;

means for supplying a paste containing an electrolyte to the gap between said electrode and said metallic material at a region upstream from said electrode as viewed in the direction of movement of said metallic object;

means for removing said paste at a region downstream from said electrode as viewed in the direction of movement of said metallic object; and means for supplying electrical current between said electrode and said metallic object of said laminate structure.

10. An electrolytic apparatus according to claim 9, wherein said electrode is a flat tabular electrode.

11. An electrolytic apparatus according to either one of claims 9 and 10, further comprising means for cleaning said laminate structure of said metallic object.

12. An electrolyte apparatus according to claim 9 wherein said electrode is a roll.

13. An electrolyte apparatus according to either one of claims 9 and 10 further comprising means for cleaning said screen.

* * * * *

UNITED STATES PATENT AND TRADEMARK OFFICE

CERTIFICATE OF CORRECTION

PATENT NO. : 4,997,529

DATED : March 5, 1991

INVENTOR(S) : Nobuo Totsuka et al

It is certified that error appears in the above-identified patent and that said Letters Patent is hereby corrected as shown below:

Column 1, line 54, delete "an electrode" and insert therefor --an electrolyte to the surface of the metallic object through the screen; placing an electrode in contact with the paste; and allowing an electric current to flow between the electrode--.

Column 1, line 60, delete "solution The" and insert therefor --solution. The--.

Column 6, line 32, delete "adhesion The" and insert therefor --adhesion. The--.

Column 11, line 58, delete "spacing about" and insert therefor --spacing: about--.

Column 11, line 59, delete "current 60" and insert therefor --current: 60--.

Column 12, line 2, before "polyacrylate" insert --A paste was prepared by adding 3.5 wt% of sodium--.

Signed and Sealed this

Eleventh Day of August, 1992

*Attest:*

DOUGLAS B. COMER

*Attesting Officer*

*Acting Commissioner of Patents and Trademarks*